US005761938A

United States Patent [19]

College

[11] Patent Number: 5,761,938

[45] Date of Patent: Jun. 9, 1998

[54] WIRE DEFECT DETECTOR FOR A WIRE HANDLING MACHINE

[75] Inventor: David A. College, Annville, Pa.

[73] Assignee: The Whitaker Corporation, Wilmington, Del.

[21] Appl. No.: 562,133

[22] Filed: Nov. 22, 1995

[51] Int. Cl.[6] ..... B21C 51/00

[52] U.S. Cl. ..... 72/5; 192/125 A; 226/11

[58] Field of Search ..... 72/5, 18.8, 19.6; 192/125 A, 125 B; 226/11

[56] References Cited

U.S. PATENT DOCUMENTS

| | | | |
|---|---|---|---|
| 3,264,740 | 8/1966 | Veale | 226/11 |
| 3,268,709 | 8/1966 | Olds | 226/11 |
| 4,797,662 | 1/1989 | Graham et al. | 72/19.6 |
| 5,244,067 | 9/1993 | Skotek et al. | 192/125 |

OTHER PUBLICATIONS

"Sensor Corporation", Scottsdale, PA, Apr. 1992, AutoNull Cable Splice and Weld Detector Model No. 80358.

*Primary Examiner*—Lowell A. Larson

*Attorney, Agent, or Firm*—Timothy J. Aberle

[57] ABSTRACT

A wire defect detection apparatus (70) is disclosed for use in a machine (10) that process wire (48) during the course of a sequence of manufacturing operations. The defect detector (70) includes a pair of rollers (80, 86), one being a follower roller (86), between which the wire is passed. The follower roller (86) is journaled for rotation on one end (88) of a pivoting arm (72), the other end (104) of the arm having an accelerometer (100) attached thereto. During operation of the machine (10), the accelerometer (100) produces a signal (118) that is received by a detection circuit (108). If the signal (118) is above or below predefined limits, indicating a defect in the wire (48), another signal (120) is sent to the controller (114) of the machine to either stop the machine or to execute some other change in the sequence of operations of the machine. Otherwise the machine (10) is permitted to continue operating uninterrupted. Additionally, a continuity test is performed between the pair of rollers (80, 86) so that wire run out or a bare wire splice (134) will result in electrical continuity between the two rollers (80, 86) which causes the detector circuit (108) to send a signal (120) to the controller (114) of the machine to either stop the machine or to execute some other change in the sequence of operations of the machine.

23 Claims, 7 Drawing Sheets

WIRE DEFECT DETECTOR FOR A WIRE HANDLING MACHINE

The present invention relates to an apparatus for detecting defects and discontinuities in a wire that is being processed by a machine and more particularly to such an apparatus for detecting knots, kinks, and splices in the wire as well as the end of the wire when the supply of wire is exhausted.

BACKGROUND OF THE INVENTION

Machines that utilize wires in the manufacture of products wherein the wire is drawn from an endless supply, such as from a barrel or a reel, require some mechanism for identifying certain defects in the wire before the portion of the wire having the defect is processed by the machine. Such defects, or discontinuities, may be knots, kinks, damaged insulation, or splices in the wire. These defects, if undetected, can produce defective parts, cause machine malfunctions, or can even damage the machine or its tooling. An example of a machine that utilizes wire in its manufacturing operation is a machine that produces wire leads for use in various electrical products or equipment. Such a machine, called a "lead maker" in the industry, feeds wire from an endless source, measuring its length precisely, then cutting it to a desired length. The ends may or may not be terminated to electrical terminals, or the ends may simply be prepared for termination. Note, that wire supplied in a so called endless source is usually contained on a reel or in a barrel. The-wire is typically over 1000 feet long and may be up to several miles long with several splices distributed along its length. These splices usually are non-insulated. The two ends of the wires are stripped of insulation and the bare conductors are tightly twisted together to form the splice, which may be one or more inches long. Occasionally, rather than twisting, the wire ends are welded together to form the splice. These machines process wire at a rate of up to 450 inches per second and may impart acceleration to the wire of up to 3000 inches per second per second. Such speeds make it difficult for an operator to visually detect defects, such as splices, in the wire and then to take appropriate action. To partially address this problem, splice detection devices have been developed consisting of two opposed metal contacts that are in engagement with opposite sides of the wire as the wire first enters the machine. When the two contacts of the splice detector encounter the splice, electrical continuity, is detected between the two contacts and the machine is automatically stopped. This detector is also effective in detecting the end of the wire when the wire supply is exhausted. An example of such a detector is disclosed in U.S. Pat. No. 5,244,067 which issued Sep. 14, 1993 to Skotek et al. While such detectors are effective in detecting splices and the end of the wire, they cannot detect knots or kinks in the wire when the insulation is intact.

What is needed is a defect detector that is effective in detecting knots and kinks in the wire being processed by the machine, as well as splices and the end of the wire upon wire run out.

SUMMARY OF THE INVENTION

A machine is disclosed utilizing a length of wire in a sequence of manufacturing operations, wherein the wire is moved along a first path. An apparatus is coupled to the machine adjacent the first path having a frame and a detector coupled to the frame. The detector is arranged to detect a discontinuity in the wire, the discontinuity being defined as a kink, a knot, or a splice, in the wire, and the end of the wire during run out. The detector is arranged so that upon detection of the discontinuity the detector will alter the sequence of operations, such as stopping the machine so that the operator can take appropriate action. The detector includes an accelerometer for detecting responsive movement of a follower that is in engagement with a surface of the wire and means for detecting electrical continuity between the follower and a roller that is in engagement with an opposite surface of the wire.

DESCRIPTION OF THE PREFERRED EMBODIMENT

Figure 1:
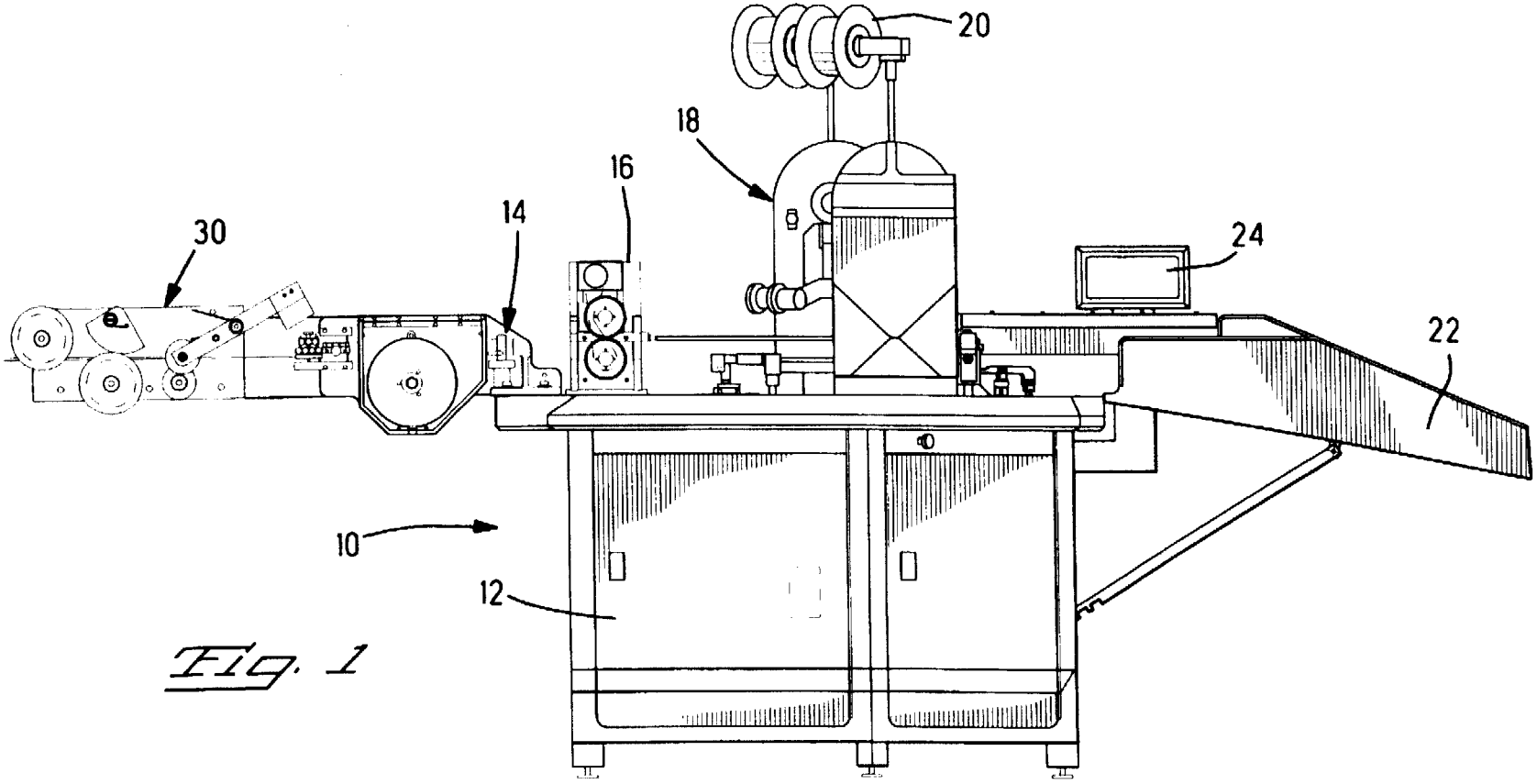
FIG. 1 is a front view of a wire lead making machine incorporating the teachings of the present invention.

There is shown in FIG. 1 a typical lead making machine 10 incorporating the teachings of the present invention. It will be understood that this machine is illustrative only and that the teachings of the present invention may be advantageously utilized with respect to other machines that utilize wire or cable in a sequence of operations in the manufacture of a product. The machine 10 includes a frame 12, a wire pre-feed assembly 14, a wire feed assembly 16, two terminating units 18 including feed reels 20 containing carrier tapes with attached terminals, a stacking tray 22, and an operator control counsel 24. The machine 10, as described above, is manufactured and distributed by AMP Incorporated under the trademark "AMPOMATOR CLS 111" and is well known in the industry. The machine 10 includes a wire guide and wire defect detector 30 coupled to the frame 12 adjacent the wire pre-feed assembly 14, as shown in FIG. 1.

Figure 4:
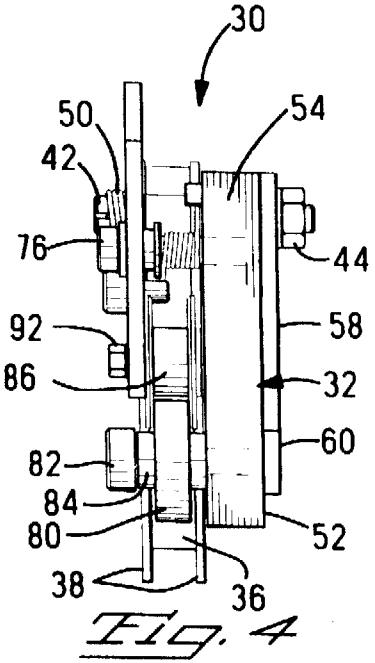
FIGS. 2, 3, and 4 are front, top, and end views of the detector and related apparatus attached to the machine shown in FIG. 1.
Figure 3:
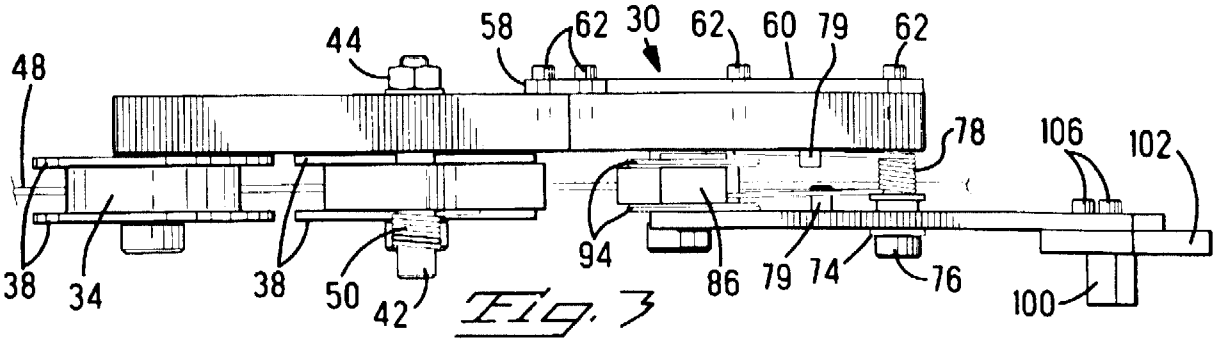
Figure 2:
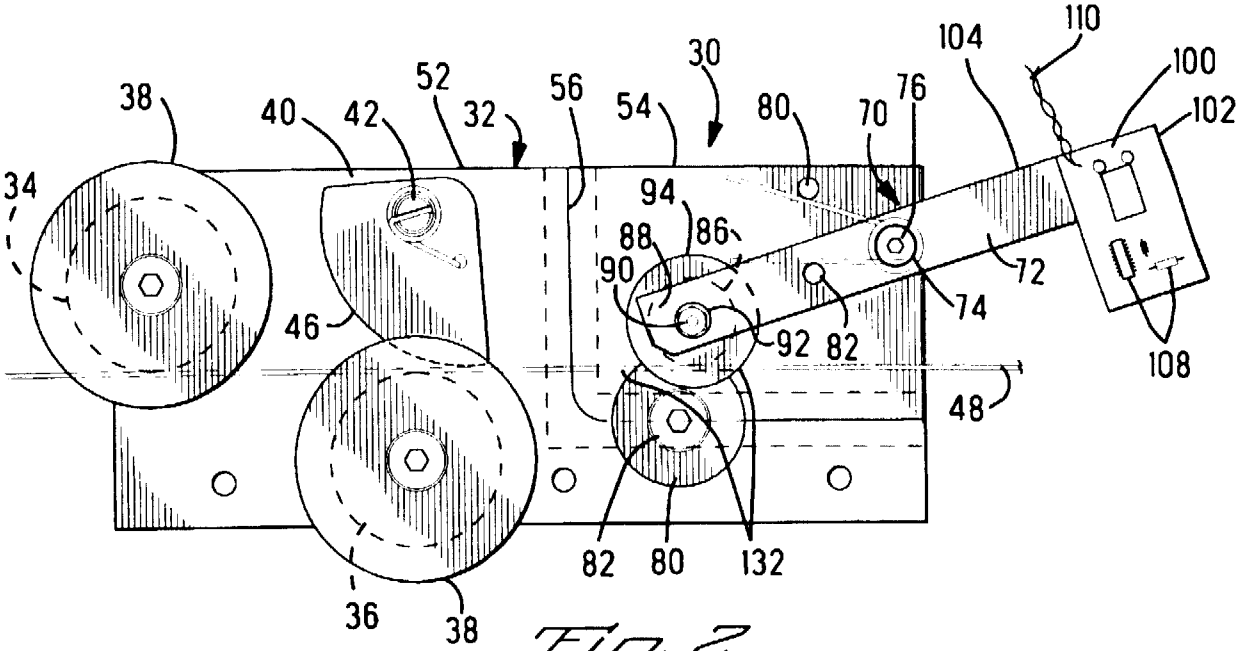

The wire guide and wire defect detector assembly 30, as best seen in FIGS. 2, 3, and 4 includes a frame 32, a pair of wire guide wheels 34 and 36 having flanges 38 on each side thereof, and an anti-backup cam 40 pivotally attached to the frame by means of a stud 42 and locknut 44. The cam 40 includes a camming surface 46 that is eccentric with respect to the stud 42 and arranged to engage the guide wheel 36 between the two flanges 38. A wire 48 is shown in feeding position in engagement with the two guide wheels 34 and 36 between the flanges 38 with the camming surface 46 resting on the wire. A spring 50 is supported on the outer end of the stud 42 and is arranged to urge the cam 40 in a clockwise direction so that the camming surface 46 is held against the wire 48. In the event that the wire 48 is urged in the direction from right to left, as viewed in FIG. 2, either inadvertently or by machine vibration, the cam 40 will tend to pivot and tightly hold the wire in place, thereby preventing movement of the wire in the wrong direction. The frame 32 includes a metal portion 52 and an insulating portion 54 that is arranged within a cutout 56 in the metal portion. Two splice plates 58 and 60 are arranged along the two edges of the cutout 56 on one side of the frame 32, as shown, and include screws 62 that extend through clearance holes in the splice plates and into threaded holes in the metal and insulating portions 52 and 54 for tightly securing the two frame portions together.

The assembly 30 includes a wire defect detector 70, as best seen in FIGS. 2, 3, and 4, which includes a pivot arm 72 pivotally attached to the insulating portion 54 of the frame 32. The pivotal attachment is effected by means of a bronze bushing 74 that is pressed into a hole in the pivot arm and a shoulder screw 76 in slip fit engagement with a hole in the bushing. The shoulder screw is tightly threaded into a hole in the insulating portion 54. A torsion spring 78 is arranged around the shank of the shoulder screw 76 and has two ends that are in engagement with two pins 79, one pin extending from the surface of the insulating portion 54 toward the pivot arm 72 and the other pin extending from the pivot arm toward the insulating portion 54. The torsion spring 78 is arranged to urge the pivot arm 72 to pivot counterclockwise, as viewed in FIG. 2. A first roller 80 is journaled for rotation on a shoulder screw 82 that is threaded into a hole in the metal portion 52 of the frame 32. A bronze bushing 84 is pressed into a hole in the first roller so that it extends outwardly on both sides of the roller, serving to space the first roller side to side and to provide a bearing surface in engagement with the shoulder screw. A second roller 86, or follower roller, is journaled for rotation on a first end 88 of the pivot arm 72 by means of a screw 90 that is threaded into a hole in the first end 88 and secured in place by a lock nut 92. A pair of washer shaped flanges 94 having inwardly facing bevels are arranged on either side of the second roller 86 so that they closely straddle a portion of the first roller 80, as shown in FIG. 2, and rotate with the second roller. The wire 48 is routed between the first and second rollers, as shown, while the two flanges 94 retain the wire therebetween. The torsion spring 78 urges the second roller 86 into engagement with the wire 48 and the first roller 80 so that the wire is sandwiched between the two rollers. In the absence of the wire 48 the two rollers, which are electrically conductive, will be in mutual electrical contact. While, in the present example, the pivot arm 72 pivots in a clockwise direction when the follower roller is moved away from the first roller 80, alternatively, the pivot 76 may be positioned on the opposite side of the follower roller 86 so that the arm 72 pivots in a counterclockwise direction. Preferably, however, the pivot 76 is positioned as shown in FIG. 2.

Figure 5:
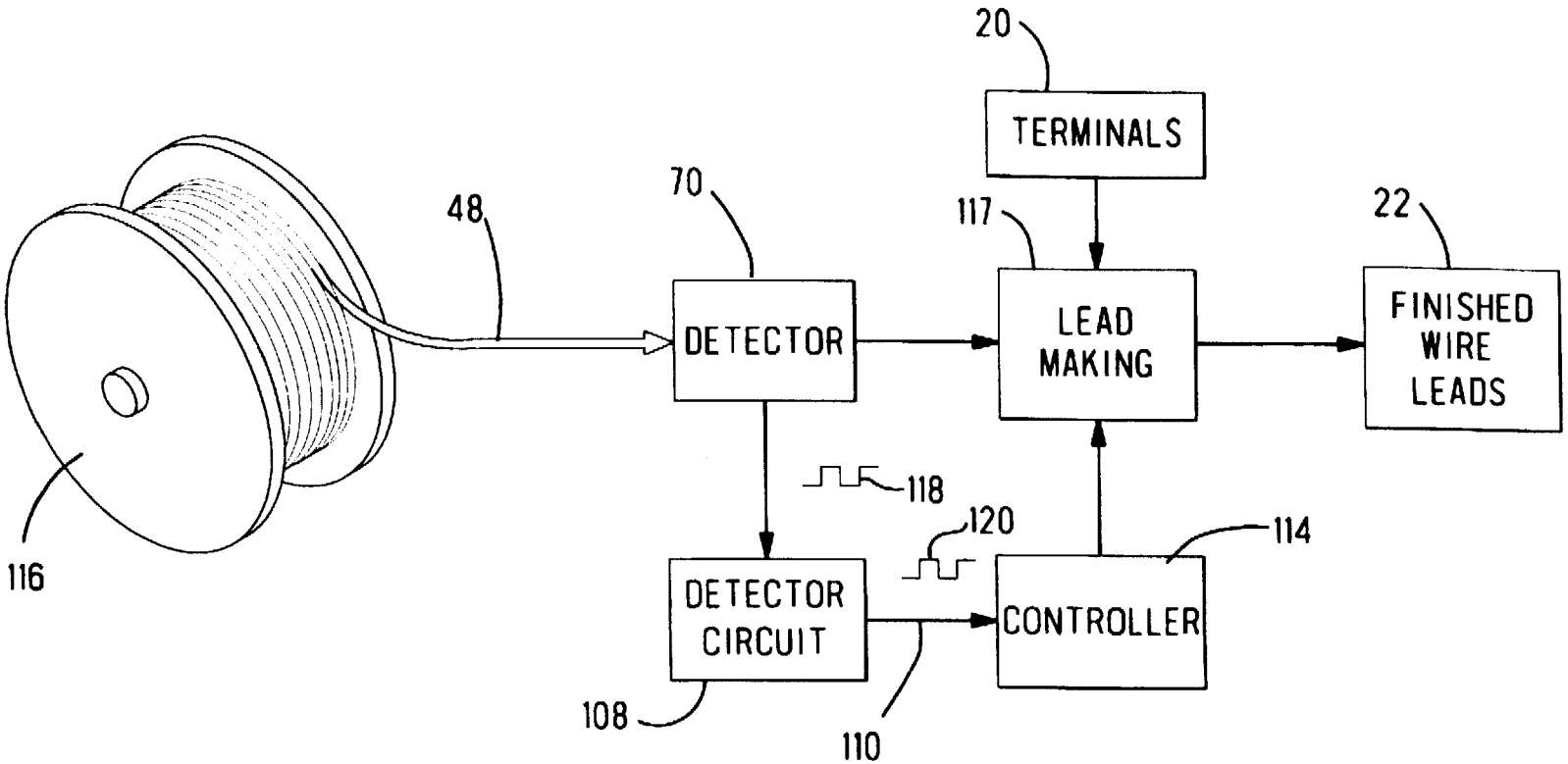
FIG. 5 is a schematic representation of the major functions of the machine shown in FIG. 1.
Figure 6:
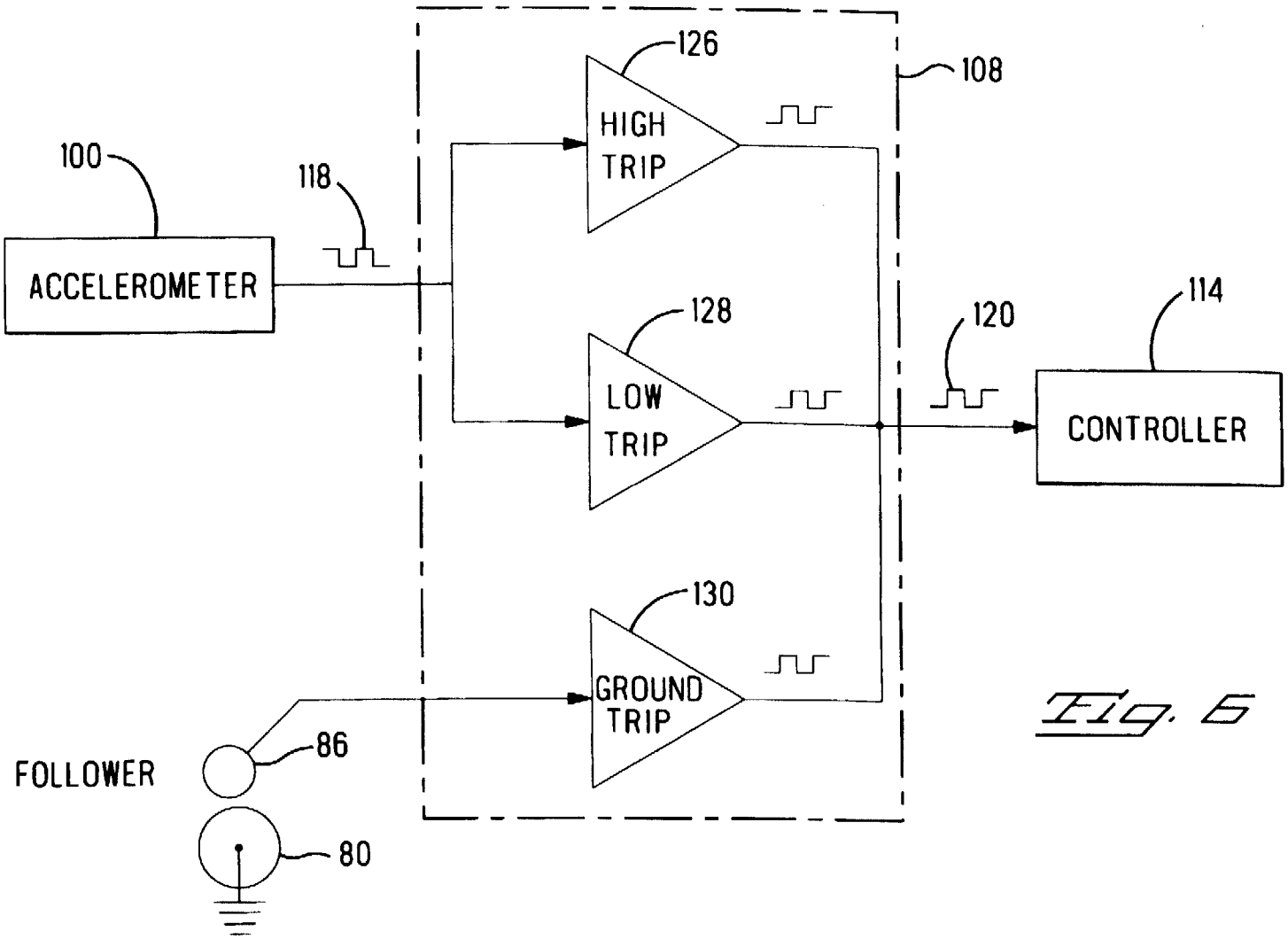
FIG. 6 is a block diagram of the detection circuit shown in FIG. 5.

The wire defect detector 70 includes an accelerometer 100 mounted to a circuit board 102, which is attached to a second end 104 of the pivot arm 72 by means of the screws 106. The circuit board 102 includes a detector circuit 108 thereon that is interconnected to the output of the accelerometer 100 to process the signal therefrom and pass the processed signal along, via leads 110, to a controller 114, as shown in FIG. 5, that controls the sequence of operations of the machine 10. As shown in FIG. 5, the wire 48 is drawn from an endless source 116, which in the present example is a reel, and passes through the defect detector 70 and on to the lead making apparatus 117 of the machine 10. The finished leads are stacked in the tray 22. A signal 118 originating from the accelerometer 100 is passed to the detector circuit 108 which, if certain criteria are met, may send a processed signal 120 via the leads 110 to the controller 114 so that the controller can alter the sequence of operations of the machine. In the present example, the controller would stop the machine and provide an indication on the operator console of the reason for the action. The detector circuit, as shown in block diagram form in FIG. 6, includes three comparators, a high trip comparator 126, a low trip comparator 128, and a ground trip comparator 130, and related circuitry. The signal 118 from the accelerometer 100 is paralleled to both the high trip and low trip comparators. When the signal 118 has an amplitude that is outside of the predefined limits of the two comparators 126 and 128, a processed signal 120 is sent to the controller 114, otherwise no signal is sent. In the event that the follower roller 86 makes contact with the first roller 80, which is grounded to the frame 12, the comparator 130 detects continuity between the follower roller and ground and passes a processed signal 120 to the controller 114.

Figure 7:
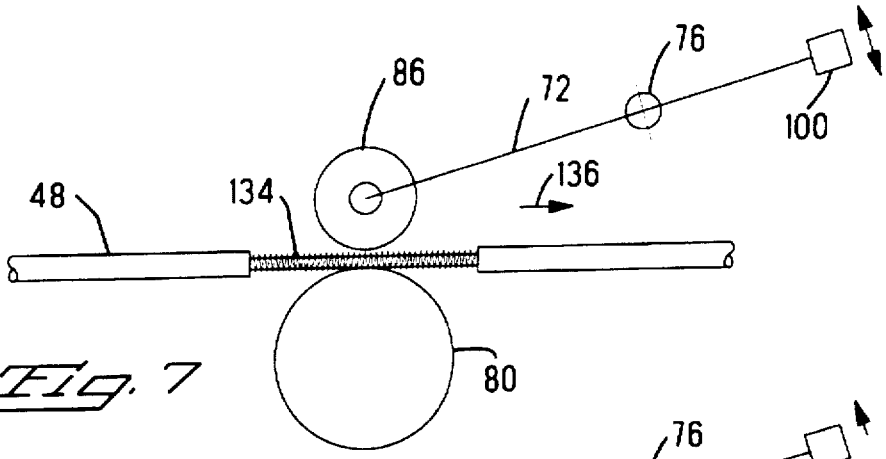
FIGS. 7, 8, 9, and 10 are schematic representations of the detector mechanism showing varying operating conditions.
Figure 8:
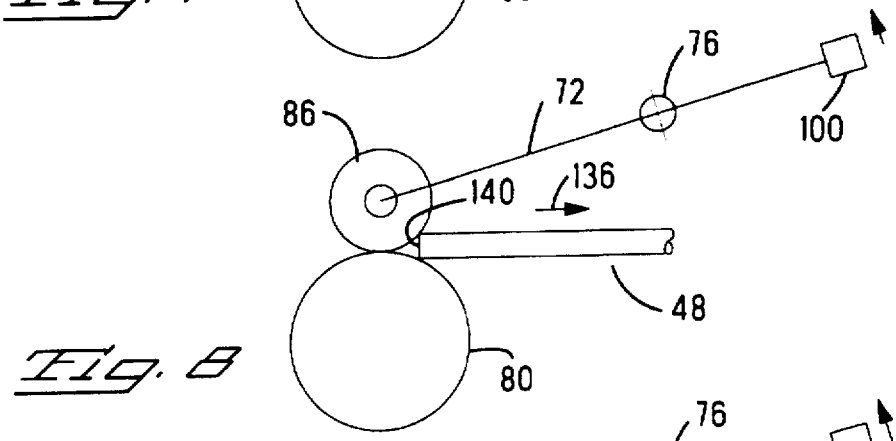
Figure 9:
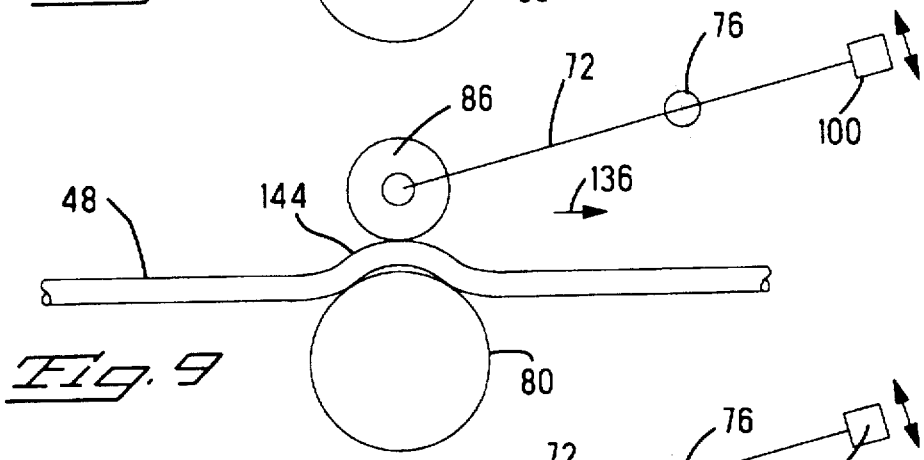
Figure 10:
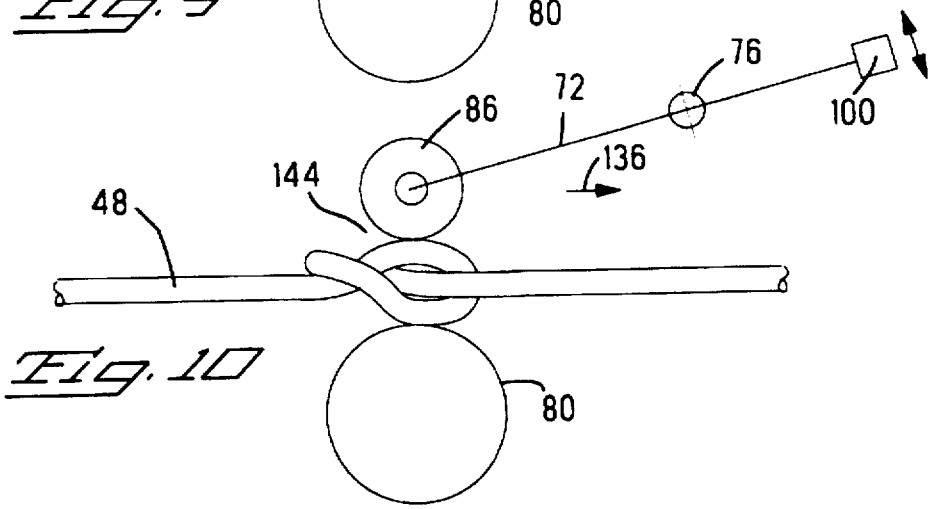
Figure 11:
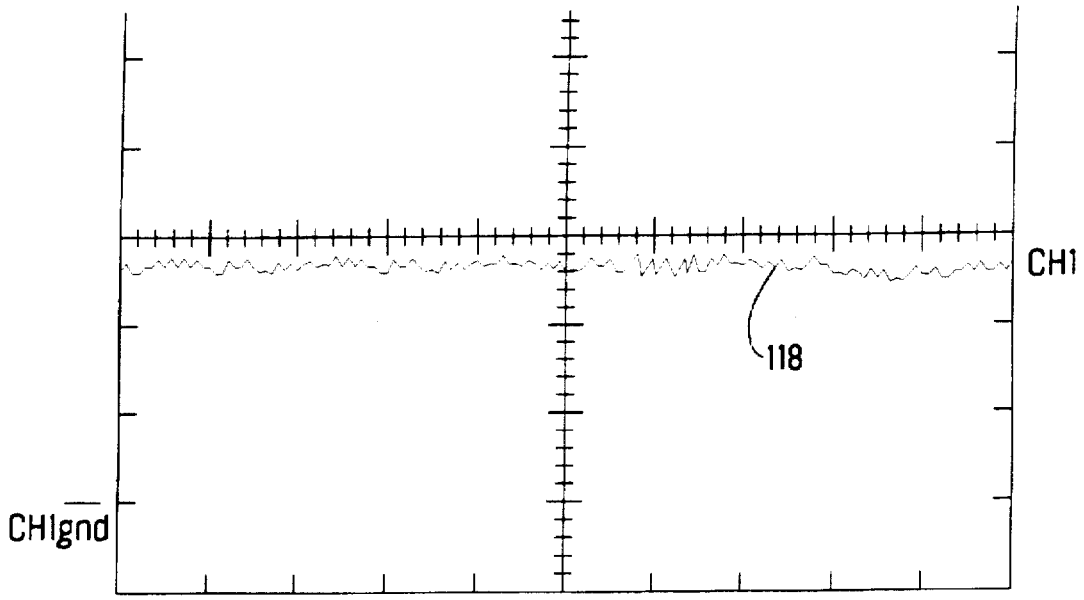
FIGS. 11, 12, 13, and 14 are graphs illustrating the electrical output of the accelerometer to the detector circuit under varying operating conditions.
Figure 12:
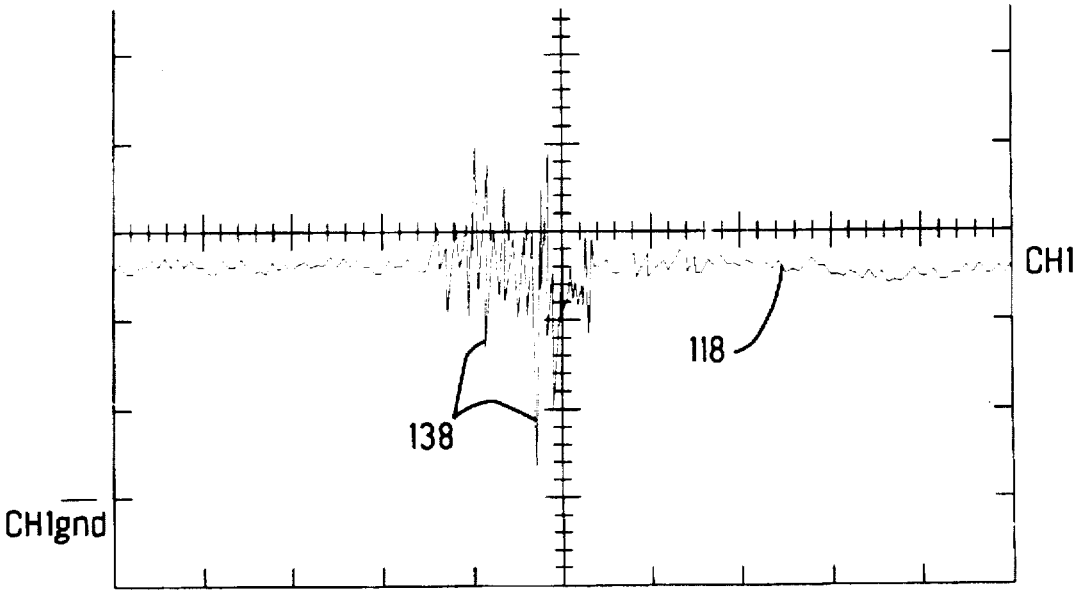
Figure 13:
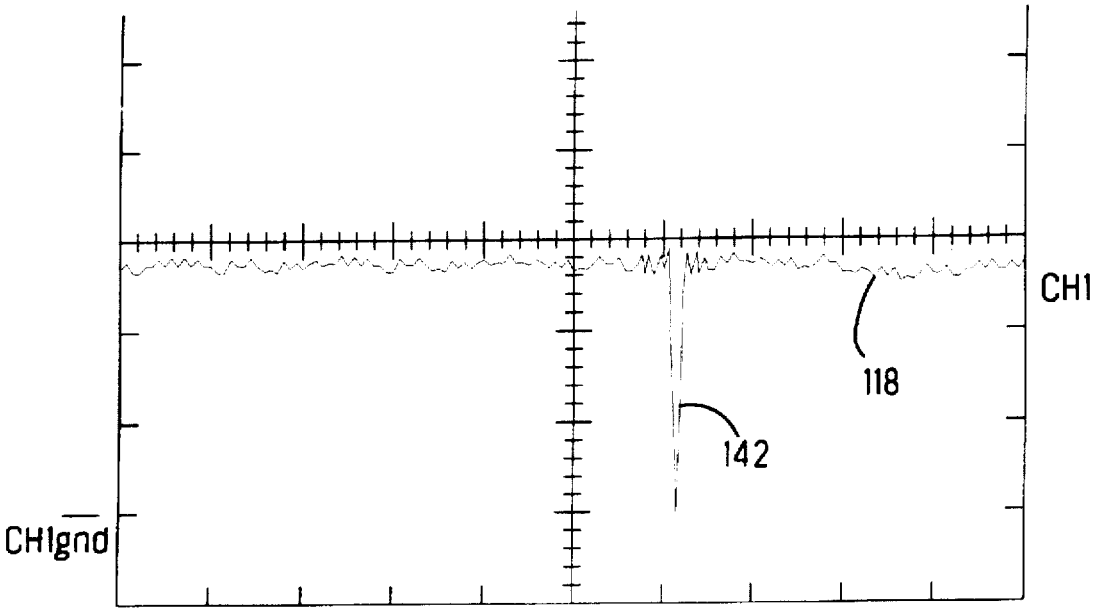
Figure 14:
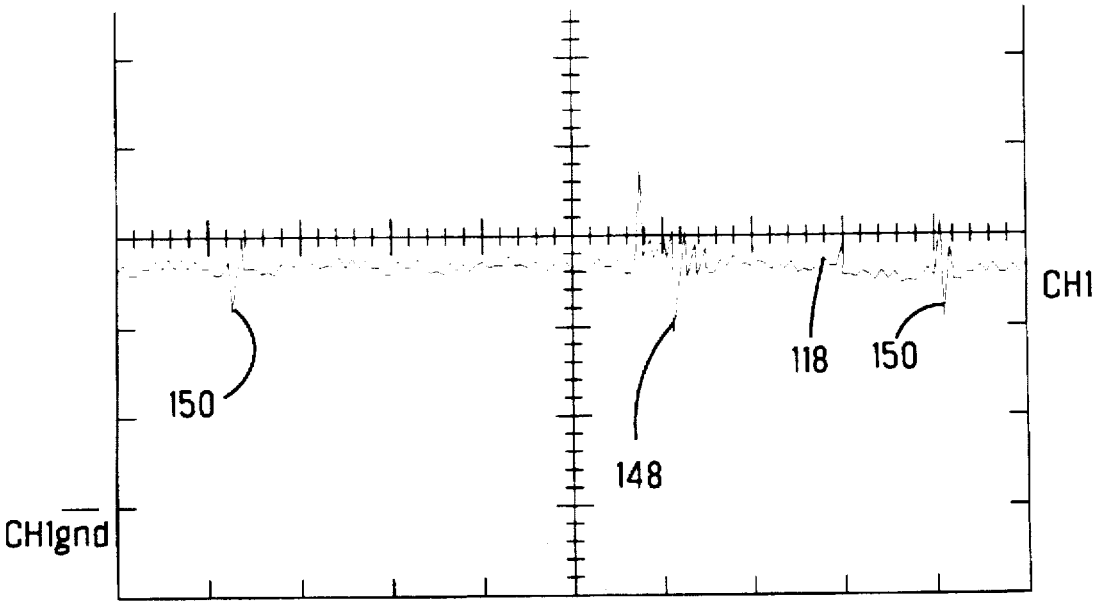

In operation, as the wire 48 traverses through the wire defect detector 70, during normal operation of the machine 10, the first and second rollers 80 and 86 rotate due to their frictional engagement with the moving wire, which is moving along a relatively straight wire path, indicated at 132 in FIG. 2, in the vicinity of the two rollers. Due to very slight variations in the outer surface of the wire and machine vibrations, the follower roller 86 will be periodically moving toward and away from the first roller 80 a slight amount, thereby causing the pivot arm 72 to oscillate about its pivot point and the accelerometer 100 to move accordingly. The accelerometer 100 detects this movement and outputs the signal 118, shown graphically in FIG. 11, to the detector circuit. Since the variations in amplitude of the signal 118 are small the high and low trip comparators 126 and 128 of the detector circuit do not pass the signal 120 to the controller 114. However, when a wire splice 134 passes between the follower roller 86 and the first roller 80, as schematically shown in FIG. 7, with the wire moving in the direction of the arrow 136, the surface roughness of the splice causes oscillation of the pivot arm 72 about its pivot point 76 that produces a signal 118 having substantial variations 138 in magnitude, as shown graphically in FIG. 12. These substantial variations 138, which occur with both twisted wire splices and welded splices, exceed the limits of the high trip and low trip comparators 126 and 128 thereby causing the signal 120 to be passed to the controller 114. Additionally, when the splice is bare wire there is electrical continuity between the follower roller 86 and the first roller 80 and the frame 12 of the machine. This is detected by the ground trip comparator 130 which passes the signal 120 to the controller 114. While the two signals 120 are redundant, they beneficially serve to provide increased reliability of the defect detector 70. When the end 140 of the wire 48 is encountered by the follower roller 86, as schematically shown in FIG. 8, again a substantial variation 142 in magnitude is produced in the signal 118, as shown graphically in FIG. 13, thereby causing the signal 120 to be passed to the controller. Additionally, as shown in FIG. 8, the follower roller 86 is in electrical contact with the first roller 80 thereby causing the ground trip comparator 130 to pass a redundant signal 120 to the controller 114. When a kink 144 or knot 146 is encountered by the follower roller 86, as schematically shown in FIGS. 9 and 10, respectively, again a substantial variation 148 in magnitude is produced in the signal 118, as shown graphically in FIG. 14, thereby causing the signal 120 to be passed to the controller. Note that, in this example, a substantial knot or kink may cause secondary variations 150 in the signal 118 as the knot or kink passes the anti-backup cam 40 and perhaps the feeding mechanism 14 of the machine 10, depending upon wire speed These secondary variations 150 may also have a magnitude large enough to cause the signal 120 to be passed to the controller.

While, in the present example, the signal 120 to the controller 114 results in a stoppage of the machine 10, any suitable alteration in the sequence of operations of the machine 10 may be effected, or new operations may be effected such as severing and discarding the portion of the wire having the defect so that production may continue. It will be understood that, while electrical wire 48 is utilized by the machine 10, such wire is by way of example only, and that the teachings of the present invention may be advantageously practiced with electrical cables having multiple wires and non-electrical wires and cables.

An important advantage of the present invention is that wire defects such as knots and kinks are easily detected and appropriate action taken to protect the integrity of the product and to prevent damage to the machine and tooling. This detection of defects is independent of whether or not the wire has an intact insulating jacket. Additionally, in the case of bare wire splices and wire run out, a second signal is sent to the controller, providing redundancy for higher reliability.

I claim:

1. In a machine utilizing a length of wire in a sequence of manufacturing operations, wherein said wire is moved along a first path, an apparatus coupled to said machine adjacent said first path having a frame and a wire defect detector coupled to said frame, said wire defect detector arranged to undergo motion upon detection of a discontinuity comprising a geometric anomaly in said wire, and a motion detector attached to and carried by said wire defect detector arranged to detect said motion of said wire defect detector, so that upon detection of said motion said motion detector will generate an electrical signal to alter said sequence of operations.

2. The apparatus according to claim 1 wherein said discontinuity includes an end of said wire encountered during wire run out.

3. The apparatus according to claim 2 wherein said discontinuity includes a splice in said wire.

4. The apparatus according to claim 3 wherein said wire defect detector includes a follower in engagement with an outer surface of said wire and arranged to effect said motion of said wire defect detector when said discontinuity is encountered.

5. The apparatus according to claim 4 wherein a portion of said motion of said wire defect detector is in a first direction when one of said kink and said knot is encountered and in a second direction when said end of said wire is encountered.

6. The apparatus according to claim 5 wherein said wire defect detector is pivotally attached to said apparatus and said motion in said first and second directions is arcuate in mutually opposite directions.

7. The apparatus according to claim 6 wherein said apparatus includes a first roller in rolling engagement with said wire and said follower includes a second roller in rolling engagement with said wire opposite to said first roller so that said wire is sandwiched between said first and second rollers.

8. The apparatus according to claim 7 wherein said first and second rollers are electrically conductive but electrically isolated from each other, said wire defect dectector including means for detecting electrical continuity between said first and second rollers, said electrical continuity being indicative of said discontinuity in said wire.

9. The apparatus according to claim 1 wherein said motion detector is an accelerometer.

10. The apparatus according to claim 9 including a follower in engagement with an outer surface of said wire and arranged to move when said discontinuity is encountered and wherein said accelerometer is coupled to said follower and arranged to detect said movement thereof and to interpret said movement as indicative of said discontinuity in said wire.

11. The apparatus according to claim 10 wherein aid follower is attached to said wire defect detector which is pivotally attached to said frame and said movement of said follower is arcuate movement.

12. The apparatus according to claim 11 including a spring means for urging said follower in said engagement with said wire.

13. The apparatus according to claim 12 wherein said accelerometer produces a signal indicative of the magnitude of acceleration of said accelerometer and said motion detector includes an electronic circuit arranged so that when said signal exceeds a predetermined magnitude said electronic circuit signals said machine to effect said altering of said sequence of operations.

14. The apparatus according to claim 13 wherein said follower includes a roller in rolling engagement with said wire and said apparatus includes another roller in rolling engagement with said wire opposite to said roller so that said wire is sandwiched between said roller and said another roller, wherein said rollers are electrically conductive but electrically isolated from each other, and said motion detector includes means for detecting electrical continuity between said rollers, said electrical continuity being indicative of said discontinuity in said wire.

15. The apparatus according to claim 1 wherein said sequence of manufacturing operations is altered by stopping said machine.

16. In a machine utilizing a length of wire in a sequence of manufacturing operations, wherein said wire is moved along a first path, first and second surfaces of said wire defining a thickness of said wire along said first path, an apparatus coupled to said machine adjacent said first path having a frame and a wire defect detector coupled to said frame, said wire defect detector in engagement with said first surface of said wire and arranged to undergo motion upon detection of a deviation from said thickness having a predetermined magnitude, said wire defect detector including a motion detector attached thereto and carried thereby and arranged so that upon detection of said motion of said wire defect detector said motion detector will generate an electrical signal to alter said sequence of operations.

17. The apparatus according to claim 16 wherein said sequence of manufacturing operations is altered by stopping said machine.

18. The apparatus according to claim 16 wherein said motion detector includes an accelerometer.

19. The apparatus according to claim 18 including a follower coupled to said wire defect detector in engagement with said first surface of said wire and arranged to move said wire defect detector when said deviation is encountered and wherein said accelerometer is attached to said wire defect detector and arranged to detect said movement thereof and to interpret said movement as indicative of said deviation in said wire.

20. The apparatus according to claim 19 wherein said wire defect detector is pivotally attached to said frame and said movement of said wire defect detector is arcuate movement.

21. The apparatus according to claim 20 wherein said apparatus includes a first roller in rolling engagement with said second surface of said wire and said follower includes a second roller in rolling engagement with said first surface of said wire so that said wire is sandwiched between said first and second rollers, and including a spring means for urging said first roller into said engagement with said second surface.

22. The apparatus according to claim 21 wherein said first and second rollers are electrically conductive but electrically isolated from each other, said detector including means for detecting electrical continuity between said first and second rollers, said electrical continuity being indicative of said discontinuity in said wire.

23. The apparatus according to claim 21 wherein said accelerometer produces a signal indicative of the magnitude of acceleration of said accelerometer and said motion detector includes an electronic circuit arranged so that when said signal exceeds a predetermined magnitude said electronic circuit signals said machine to effect said altering of said sequence of operations.

* * * * *